US007642968B2

(12) United States Patent
Minard et al.

(10) Patent No.: US 7,642,968 B2
(45) Date of Patent: Jan. 5, 2010

(54) PORTABLE DEVICE COMPACT ANTENNA

(75) Inventors: Philippe Minard, Saint Medard sur Ille (FR); Jean-François Pintos, Bourgbarre (FR); Ali Louzir, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 283 days.

(21) Appl. No.: 11/653,612

(22) Filed: Jan. 16, 2007

(65) Prior Publication Data

US 2007/0164914 A1 Jul. 19, 2007

(30) Foreign Application Priority Data

Jan. 17, 2006 (FR) ..... 06 50153

(51) Int. Cl.
*H01Q 1/24* (2006.01)
*H01Q 5/02* (2006.01)
*H01Q 9/14* (2006.01)

(52) U.S. Cl. ..... 343/702; 343/823

(58) Field of Classification Search ..... 343/702, 343/793, 795, 805, 823
See application file for complete search history.

(56) References Cited

U.S. PATENT DOCUMENTS 4,123,756 A * 10/1978 Nagata et al. ..... 343/702
4,313,119 A * 1/1982 Garay et al. ..... 343/702
5,812,097 A * 9/1998 Maldonado ..... 343/790
6,307,511 B1 * 10/2001 Ying et al. ..... 343/702
6,573,868 B2 6/2003 Johnson et al.
6,842,149 B2 1/2005 Taubman
6,870,513 B2 3/2005 Deng et al.

FOREIGN PATENT DOCUMENTS

EP 1 667 279 A1 6/2006
WO WO 00/62432 A 10/2000
WO WO 2005/031916 A 4/2005

OTHER PUBLICATIONS

Search Report dated Oct. 24, 2006.

* cited by examiner

*Primary Examiner*—Michael C Wimer
(74) *Attorney, Agent, or Firm*—Robert D. Shedd; Jeffrey M. Navon

(57) ABSTRACT

The present invention relates to a portable compact antenna comprising a first radiating element of the dipole type, operating in a first frequency band and formed by a first and at least one second conductive arm supplied differentially, the first arm, called cold arm, forming at least one cover for an electronic card wherein the second arm, called hot arm, is extended by a conductive wire element, the length of the assembly formed by the first arm, the second arm and the wire element being chosen to provide an operation in a second frequency band.

10 Claims, 8 Drawing Sheets

PORTABLE DEVICE COMPACT ANTENNA

This application claims the benefit, under 35 U.S.C. § 119 of French Patent Application 0650153, filed Jan. 17, 2006.

The present invention relates to a portable compact antenna, more particularly an antenna designed to receive television signals, notably the reception of digital signals on a portable electronic device such as a portable computer, a PDA (personal assistant) or any other similar device requiring an antenna to receive electromagnetic signals.

BACKGROUND OF THE INVENTION

On the current accessories market, there are items of equipment that can receive signals for digital terrestrial television (TNT) directly on a laptop computer. The reception of digital terrestrial television signals on a laptop computer can benefit from the computation power of the said computer to decode a digital image, particularly for decoding a flow of digital images in. MPEG2 or MPEG4 format. This equipment is most frequently marketed in the form of a unit with two interfaces, namely one RF (radiofrequency) radio interface for connection to an interior or exterior VHF-UHF antenna and a USB interface for the connection to the computer.

The devices currently on the market are generally constituted by a separate antenna such as a whip or loop type antenna mounted on a unit carrying a USB connector.

In the French patent application no. 05 51009 filed on 20 Apr. 2005, the applicant proposed a compact wideband antenna covering the entire UHF band, constituted by a dipole type antenna. This antenna is associated with an electronic card that can be connected to a portable device, notably by using a USB type connector.

More specifically, the antenna described in the French patent application no. 05 51009, comprises a first and a second conductive arm supplied differentially, one of the arms, called first arm, forming at least one cover for an electronic card. More specifically, the first arm has the form of a box into which the electronic card, comprising the processing circuits of the signals received by the dipole type antenna, is inserted. These circuits are most often connected to a USB type connector enabling the connection to a laptop computer or any other similar device.

The solution proposed in this patent application covers the entire UHF band. However, to be able to provide the widest possible cover with a product of this type, it is important to be able to receive, in addition to the UHF band (470-862 MHz) at least the VHF-III band (174-225 . . . 230 MHz) in which some countries such as Germany or Italy continue to broadcast digital multiplexes.

SUMMARY OF THE INVENTION

The present invention therefore relates to a portable compact antenna capable of meeting this requirement.

The portable compact antenna in accordance with the invention comprises a first radiating element of the dipole type, operating in a first frequency band and formed by a first conductive arm and at least one second conductive arm supplied differentially, the first arm, called cold arm, forming at least one cover for an electronic card characterized in that the second arm, called hot arm, is extended by a wire element, the length of the assembly formed by the first arm, the second arm and the wire element being chosen to provide an operation in a second frequency band.

According to one characteristic of the present invention, the length of the assembly is equal to $\lambda 2/(2\times(1+\alpha))$ where $\lambda 2$ is the wavelength at the central frequency of the second frequency band and $\alpha$ a coefficient between 0 and 1. Preferably, $\alpha$ is a coefficient between 0.15 and 0.2. This coefficient is used to adjust the theoretical resonant frequency of the antenna in relation to the frequency of use in such a manner to obtain impedance matching.

According to one preferential embodiment of the present invention, the first frequency band is the UHF band and the second frequency band is the VHF band, preferably the VHF-III band.

For an operation at the UHF band, the first and second arms each have a length equal to $\lambda 1/4$ where $\lambda 1$ is the wavelength at the central frequency of the first frequency band, namely the UHF band.

According to one embodiment, the wire element is provided in the hot arm. According to yet another embodiment, the wire element is formed by retractable sections in a sleeve integral with the hot arm.

Moreover, to obtain an antenna operating with diversity, the first radiating element comprises two second arms mounted in rotation at one extremity of the first arm, each second arm being extended by a wire element.

DESCRIPTION OF THE DRAWINGS

Other characteristics and advantages of the present invention will emerge upon reading the description of different embodiments, this description being made with reference to the drawings attached in the appendix, in which.

To simplify the description, the same elements have the same references in the figures.

DESCRIPTION OF EMBODIMENTS

Figure 1:
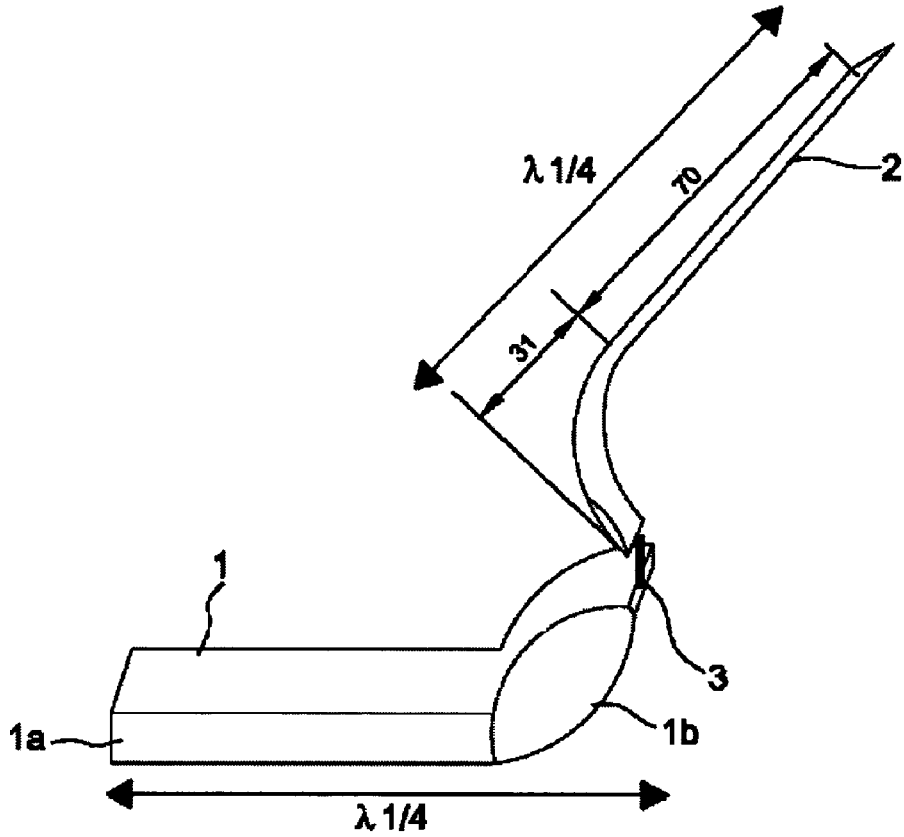
FIG. 1 is a diagrammatic perspective view of an antenna as described in the French patent no. 05 51009 in the name of the applicant.

With reference to FIG. 1, a description will first be made of an embodiment of a dipole type antenna that can be used for receiving terrestrial digital television on a laptop computer or similar device in compliance with the French patent application no. 05 51009 in the name of the applicant.

As shown in FIG. 1, this dipole type antenna comprises a first conductive arm 1 also known as cold arm and a second conductive arm 2 also known as hot arm, both arms being connected to each other by means of an articulation zone 3 located at one of the extremities of each of the arms.

More specifically, the arm 1 noticeably has the shape of a box notably being able to receive an electronic card. The box has a part 1*a* of a noticeably rectangular form, extending by a curved part 1*b* opening out gradually so that the energy is radiated gradually, which increases the impedance matching over a wider frequency band. The length of the arm 1 is noticeably equal to $\lambda 1/4$ where $\lambda 1$ is the wavelength at the central operating frequency. Hence, the length of the arm 1 approaches 112 mm for an operation in the UHF band (frequency band between 470 and 862 MHz).

As shown in FIG. 1, the antenna comprises a second arm 2 mounted in rotation around the axis or pin 3 which is also the point of connection of the antenna to the signal processing circuit, namely to the electronic card not shown inserted into the box formed by the arm 1. The electrical connection of the antenna is made by a metal strand, for example a coaxial or similar cable, whereas the rotation axis is made of a material relatively transparent to electromagnetic waves.

As shown in FIG. 1, the arm 2 that can be articulated around the pin 3 has a length noticeably equal to $\lambda 1/4$. The arm 2 also has a curved profile followed by a flat rectangular part enabling it to be folded back fully against the arm 1 in closed position. The arm 2 being mounted in rotation at 3 with respect to the arm 1, this enables the orientation of the arm 2 to be modified so as to optimise the reception of the television signal.

The antenna represented in FIG. 1 was dimensioned to operate in the UHF band. However, to ensure the widest possible commercial coverage, it is interesting that an antenna of this type can receive the VHF frequency band, in addition to the UHF frequency band, more particularly the VHF-III frequency band (174-225 . . . 230 MHz) in which some countries such as Germany or Italy continue to broadcast digital multiplexes.

Thus, on FIG. 2, a first embodiment was shown with an antenna in accordance with the present invention, being able to function both within the UHF and VHF band, as will be explained in more detail hereafter. The connection to the signal processing circuits is thus made at the level of the pin 3.

Figure 2:
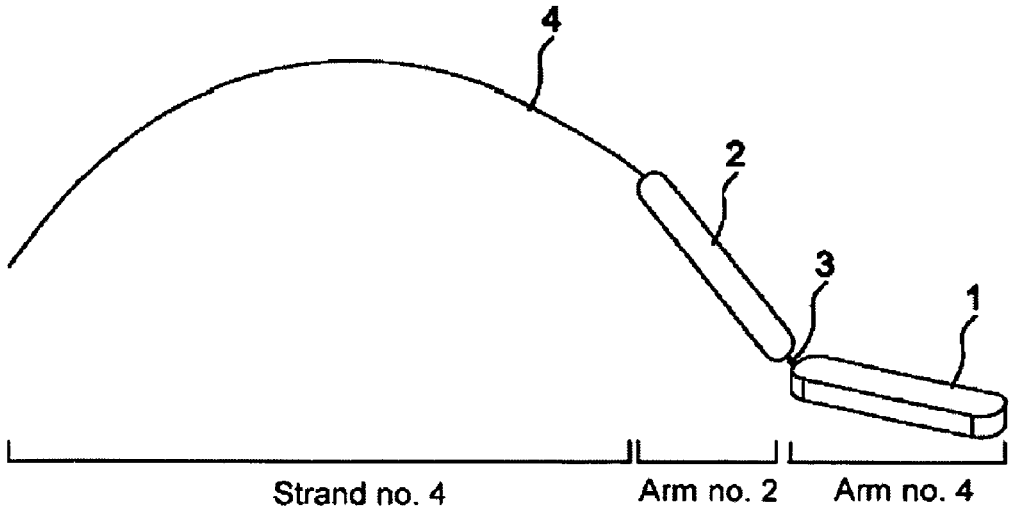
FIG. 2 is a diagrammatic perspective view of a first embodiment of an antenna in accordance with the present invention.

As shown in FIG. 2, the antenna in accordance with the present invention contains a first arm 1 or cold arm with, like the arm 1 of the antenna of FIG. 1, the form of a box. This arm 1 is extended by an arm 2 or hot arm connected to the rotation arm 1 by means of a pin or axis 3.

In accordance with the present invention and as shown in FIG. 2, the hot arm 2 is extended by a wire element or strand 4. The assembly constituted by the arm 1, the arm 2 and the wire element 4 is made of a conductive material, preferably a metal or metallizable material.

In accordance with the present invention and as explained in more detail with reference to the diagram of FIG. 3, the total length, namely the electrical length of the assembly formed by the arm 1, the arm 2 and the wire element 4 is chosen to enable the impedance matching of the antenna in the VHF-III (174-230 MHz) and UHF (470-862 MHz) bands. Consequently, the total length is noticeably equal to $0.5\times\lambda 2/(1+\alpha)$ in which $\lambda 2$ is the wavelength at the central frequency of the VHF-III band and $\alpha$ is a coefficient between 0 and 1, preferably between 0.15 and 0.2, this coefficient being used to adjust the theoretical resonant frequency of the antenna with respect to the frequency of use so as to be able to provide its impedance matching, as will be explained in more detail hereafter. To be able to receive the UHF band, as mentioned above with reference to FIG. 1, the arm 1 and the arm 2 have noticeably equal lengths L1 and L2 such that $L1\cong\lambda 1/4$ and $L2\cong\lambda 1/4$ where $\lambda 1$ is the wavelength at the central frequency of the UHF band. Hence, for a central UHF frequency of 666 MHz, the length of each arm 1 and 2 of the dipole is noticeably equal to 11 cm.

Figure 3:
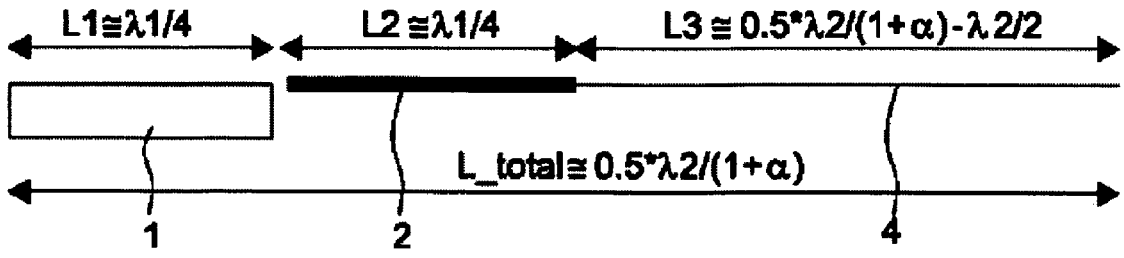
FIG. 3 is a diagram showing the lengths of the different elements forming the antenna in accordance with the present invention.
Figure 4:
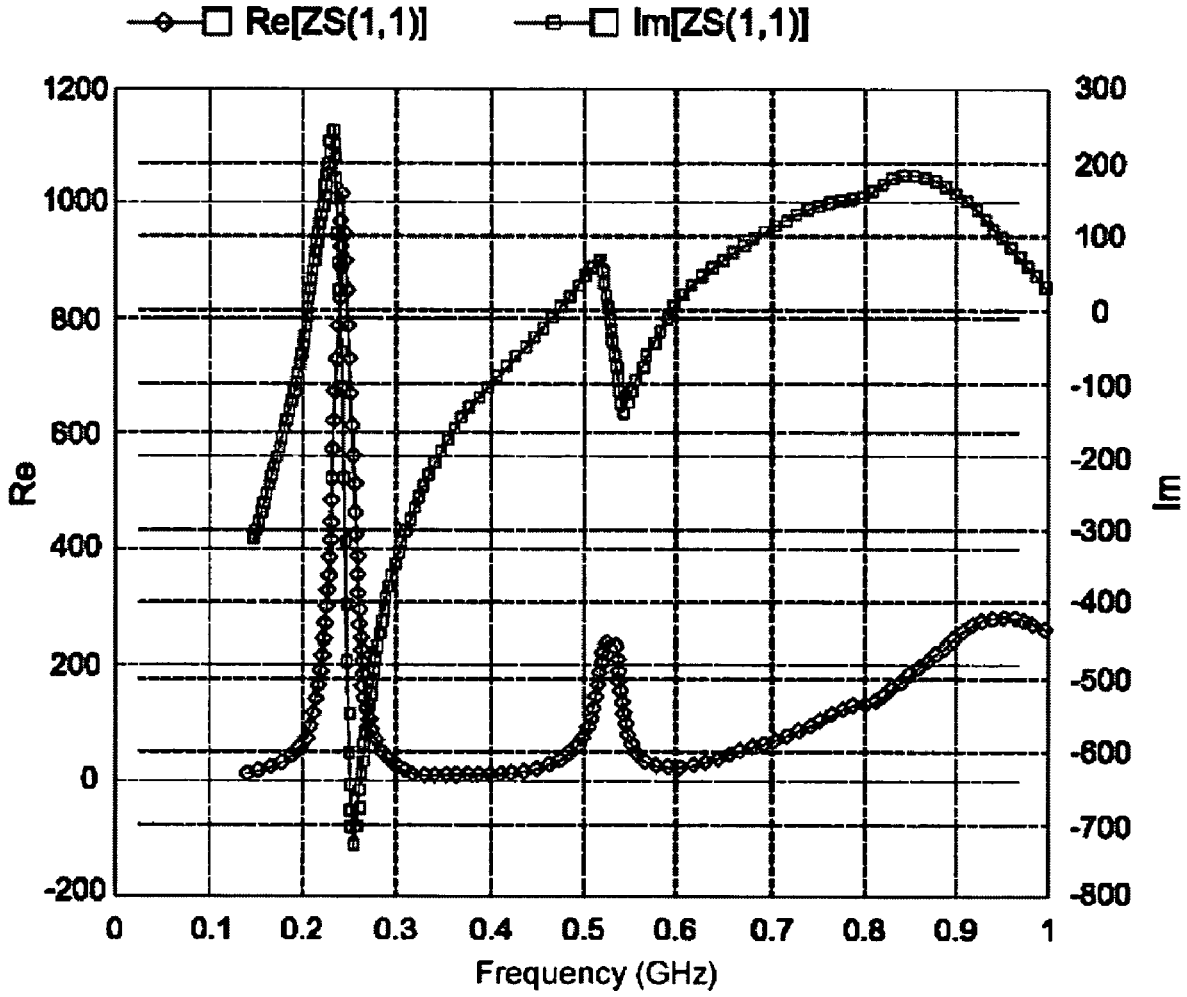
FIG. 4 shows the real and imaginary parts of the impedance of the antenna having the dimensions provided in FIG. 3 on the VHF and UHF frequency bands.

To ensure operation in the VHF band, as shown in FIG. 3, the total length of the assembly constituted by the arm 1, the arm 2 and the wire element 4 is equal to approximately $\lambda 2/2(2\times(1+\alpha))$ where $\lambda 2$ is the wavelength at the central frequency of the VHF band. Preferably, $\alpha$ is between 0.15 and 0.2. This means impedance matching the antenna at a slightly higher frequency than the central frequency, namely $f\cong f2\times(1+\alpha)$. In fact, this shift enables, while maintaining a good efficiency, the antenna to be impedance matched at the working frequency. Indeed, as shown in FIG. 4, the impedance presented by the antenna is high at resonance, namely when the imaginary part is null. This impedance has a value of around 1000 ohms. It is therefore difficult to match the antenna for a load impedance in the order of 50 or 75 ohms, for example. To obtain a lower antenna impedance, it is possible to search for a lower operating frequency located above the resonant frequency. However, to reduce the size of the wire element, it is rather preferable to operate the antenna below the resonant frequency; this is why, the resonant frequency is chosen above the working frequency in order to reduce the antenna size.

Hence, as shown in FIG. 3, the length of the wire element 4 equals $L3\cong 0.5\times\lambda 2/(1+\alpha)-\lambda 2/2$. Therefore, for an operating frequency in the VHF band of F2=200 MHz and a coefficient $\alpha=0.175$, a wire element length of around 41 cm is obtained.

With the embodiment described above, in the VHF band, the antenna can be seen as an asymmetric dipole. Moreover, at the UHF frequencies, the electrical impedance plane brought by the wire element to the edge of the hot arm, namely the arm 2, is the equivalent to an open circuit plane and is therefore fairly transparent to UHF frequencies. By using the design rules described above, the addition of a metal wire element at the extremity of the hot element interferes very little with the operation of the antenna in the UHF band.

With reference to FIGS. 5 to 10, a description will be made of the simulation results obtained with an antenna in accordance with the present invention, as described above. The antenna simulations were carried out with the IE3D software of Zeland. The material used for the simulations is defined with a conductivity of $4.9\times10^7$ (S/m) and a thickness of 35

μm. The optimisation of the impedance matching network FIG. 6 was carried out with the ADS software of Agilent Technologies.

Figure 5:
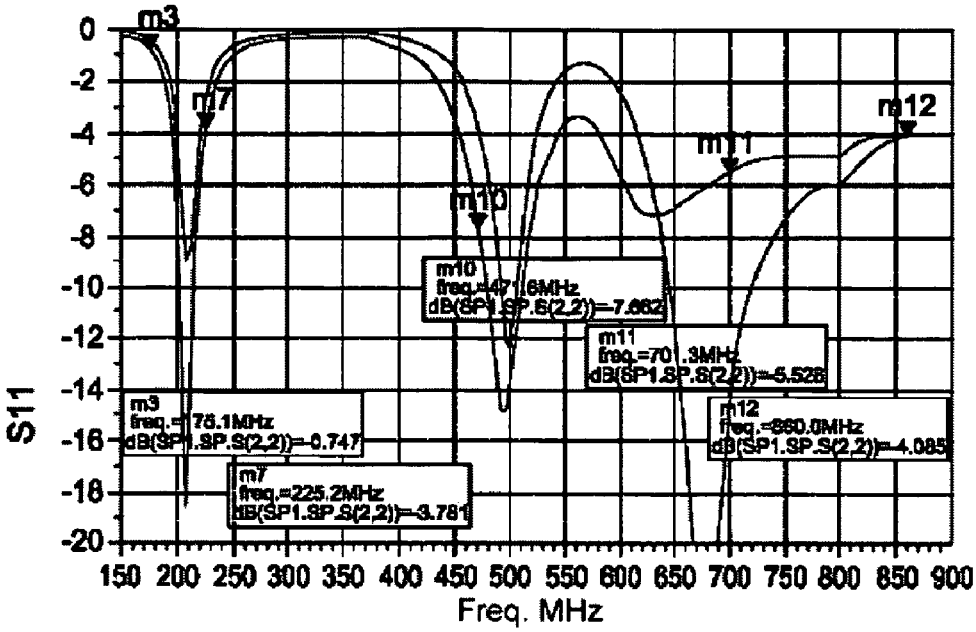
FIG. 5 shows two impedance matching curves, the one being the S11 response of the antenna without an impedance matching network, the other being the S11 response of an antenna with an impedance matching network.
Figure 6:
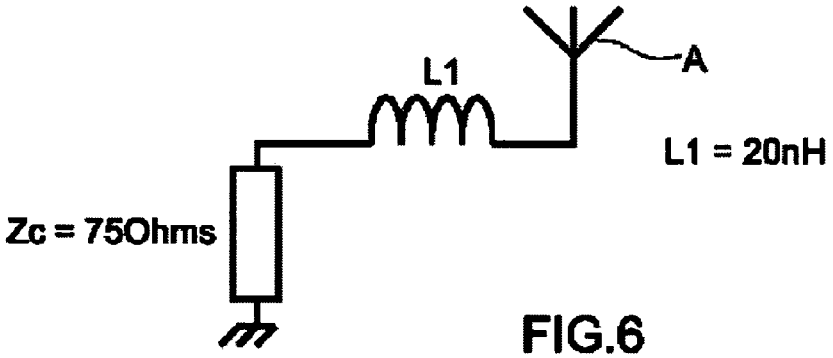
FIG. 6 is a diagrammatic representation of the impedance matching network used to obtain the results of FIG. 5.

FIG. 5 shows two impedance matching curves, one being the S11 response of the antenna simulated without an impedance matching network and the other the S11 response of the antenna simulated with an impedance matching network such as the one shown in FIG. 6. The impedance matching network is constituted by an impedance Z having a value Zc=75 ohms in the embodiment shown. It comprises a self-impedance L1 mounted in series between the antenna A and the impedance Z. The self-impedance L1 has a value of 20 nH. This impedance matching network enables impedance matching for a 75 ohms load, both for the VHF band and the UHF band. FIG. 5 shows the improvement of the S11 response made by the impedance matching network on the two VHF and UHF frequency bands. The S11 level in the VHF frequency band (UHF respectively) is therefore better than −0.7 dB (4 dB respectively), the markers (m3, m7, m10 and m12) specifying the S11 levels obtained after optimisation for the antenna with its impedance matching network.

Figure 7:
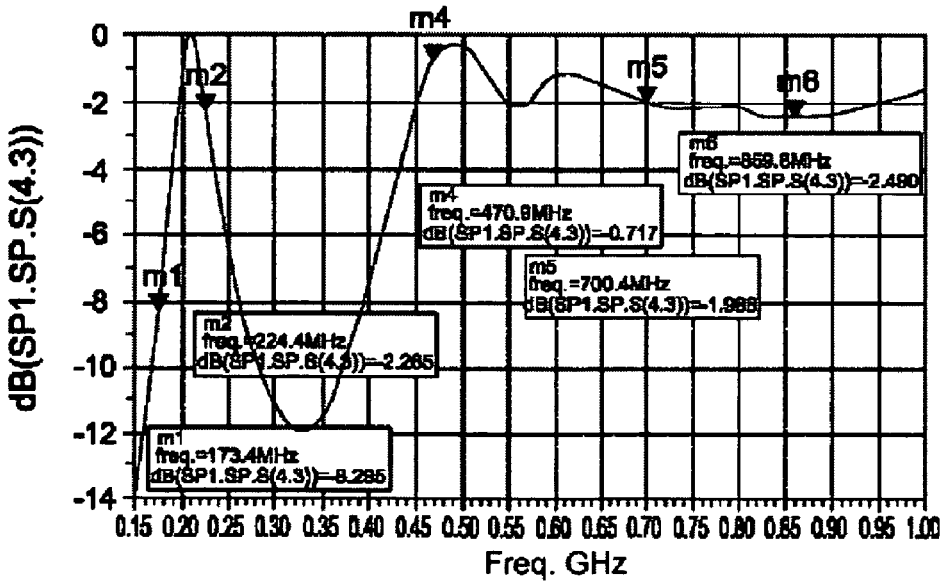
FIG. 7 is a curve showing the losses of the impedance matching network.

Moreover, as shown in FIG. 7, the losses of the impedance matching network are 2.5 dB in the UHF band, namely between 470 and 862 MHz, and 8 dB in VHF band, namely between 174 and 230 MHz.

Figure 8:
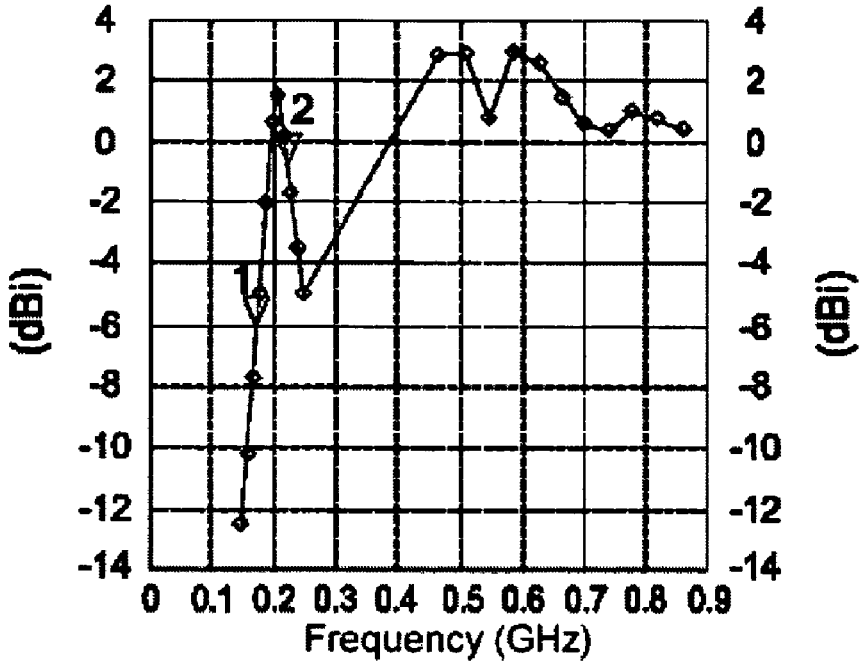
FIG. 8 is a curve showing the antenna gain in the VHF and UHF band.

FIG. 8, which represents the gain of the antenna on the two bands, shows that the VHF band gain is between −6 dB and 1.8 dB whereas the UHF band gain is between 0.5 dB and 3 dB.

Figure 9:
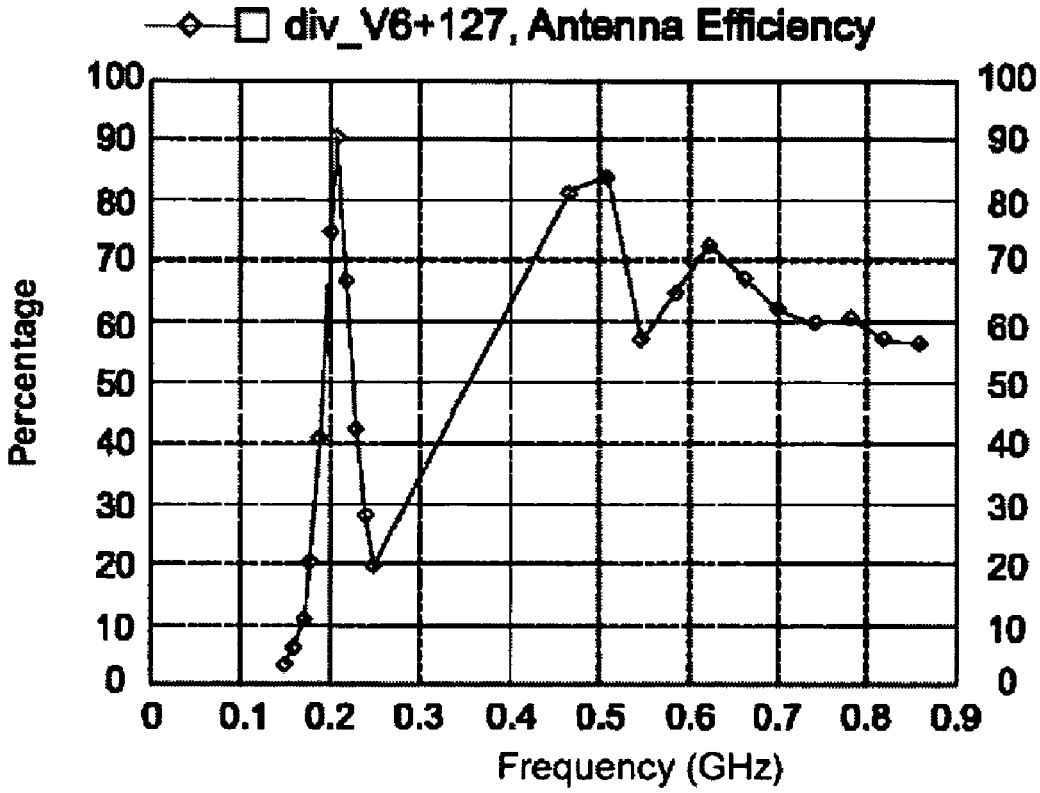
FIG. 9 is a curve showing the antenna efficiency in the VHF and UHF band.

Moreover, as shown in FIG. 9, which represents the efficiency of the antenna in both bands, the antenna has an efficiency of at least 20% in the VHF band and at least 58% in the UHF band.

Figure 10:
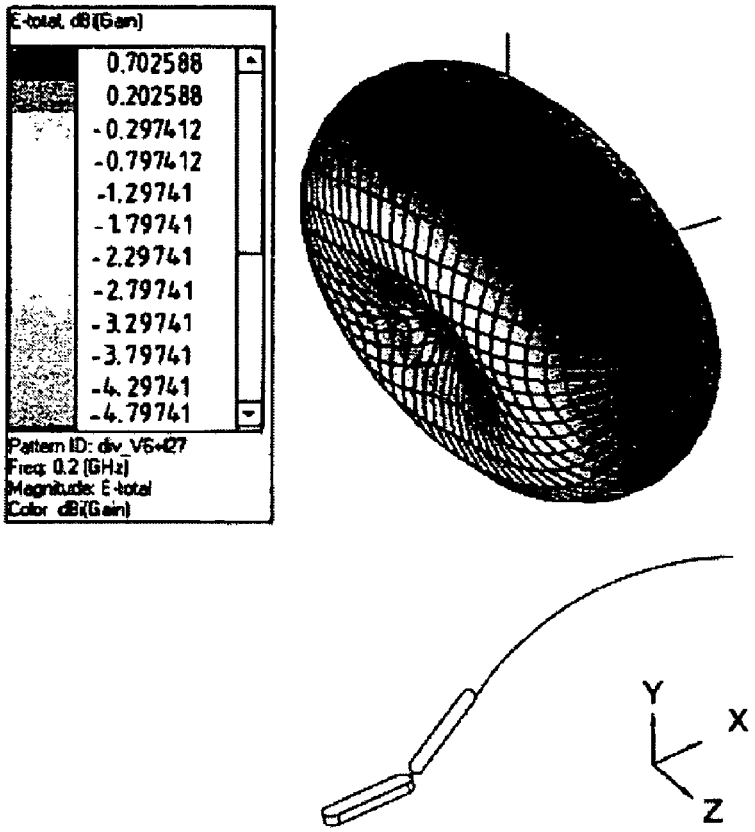
FIG. 10 shows the radiation patterns respectively in the UHF and VHF bands, obtained by simulating an antenna in accordance with FIG. 3 and FIG. 4.
Figure 10:
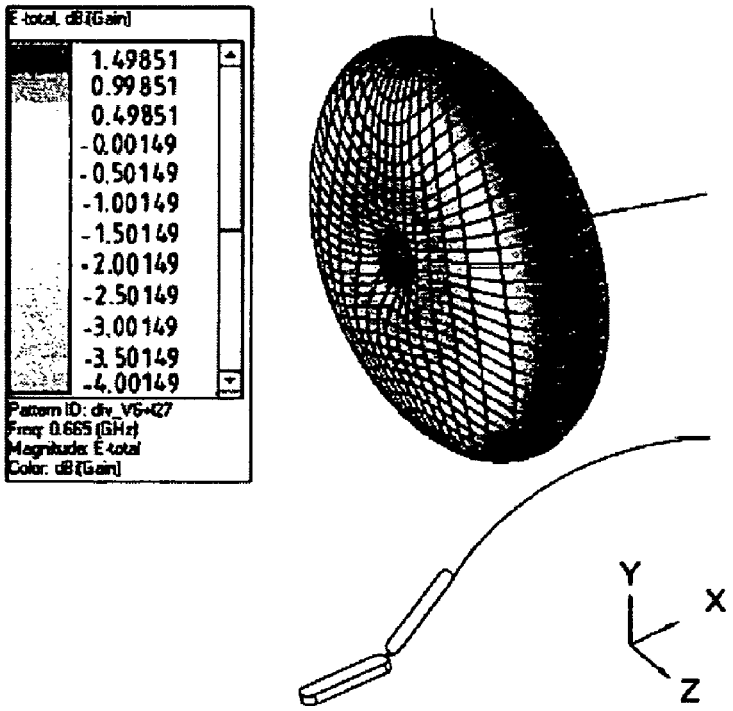

Furthermore, FIG. 10 shows the simulated radiation patterns of an antenna such as shown in FIG. 2 respectively in the UHF and VHF bands. These quasi-omnidirectional patterns confirm that the antenna has a dipole type behaviour in both cases.

Figure 11:
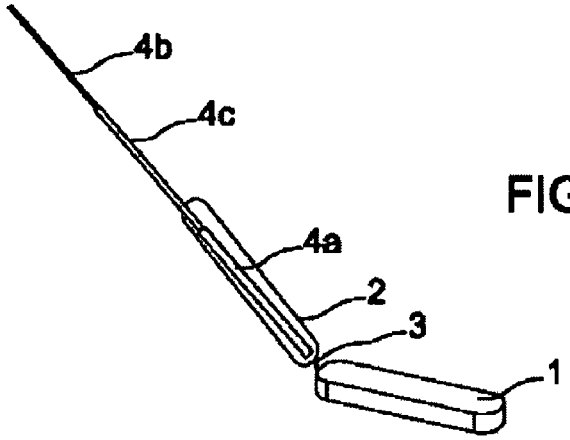
FIG. 11 is a diagrammatic perspective representation of another embodiment of an antenna in accordance with the present invention.

The different variants of embodiment will now be described. Hence, FIG. 11 shows a first variant in which the wire element is constituted by retractable elements 4*a*, 4*b*, 4*c*. One of the elements 4*a* forms a metal sleeve 4*a* fixed on the hot arm 2 in which the two other elements 4*a*, 4*b* forming the wire strand can be inserted. This enables the antenna to be impedance matched by using the wire strand only if a VHF band reception is required. In this case, the UHF operation is noticeably the same as the length of the retractable elements overshooting the hot arm bring an open circuit plane to the extremity of this arm, which makes the retractable elements relatively transparent. Moreover, the small increase in thickness in the hot arm located at the level of the metal sleeve 4*a* does not degrade the UHF operation, all the more so as it is moreover known by those skilled in the art that the increase in volume of a dipole antenna tends to increase its impedance matching band.

Figure 12:
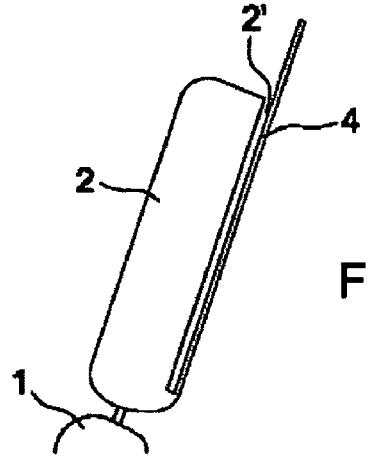
FIG. 12 is a diagrammatic perspective representation of one part of an antenna in accordance with yet another embodiment of the present invention.
Figure 13:
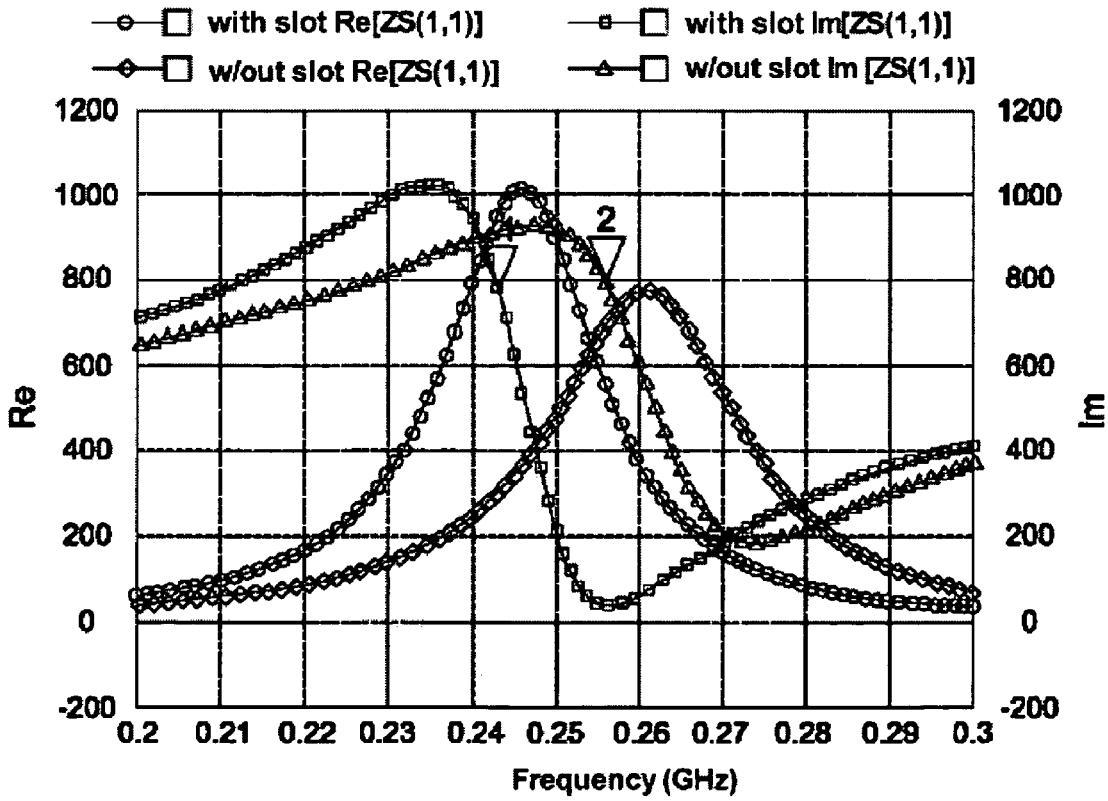
FIG. 13 shows the simulation results of the real and imaginary parts of the impedance of the antenna of FIG. 12, with or without slot.

In FIG. 12, yet another embodiment of the present invention is shown. In this case, the hot arm 2 features a slot 2' next to which the wire element 4 is inserted. This embodiment can reduce the length of the wire element. Indeed, as shown in FIG. 13 which shows the real and imaginary parts of the antenna impedance with or without a slot, it can be seen that the addition of a slot of 0.2 mm wide and 9 cm long, drops the resonant frequency by 14 MHz. Indeed, at an equal resonant frequency, the length of the conductive wire element decreases by 4 cm.

The proportion between the length of the slot 2*a* and the reduction of the wire element, depends on the relative wavelength between the conductive wire element in the air and the extension of the wire element along the arm 2.

Figure 14:
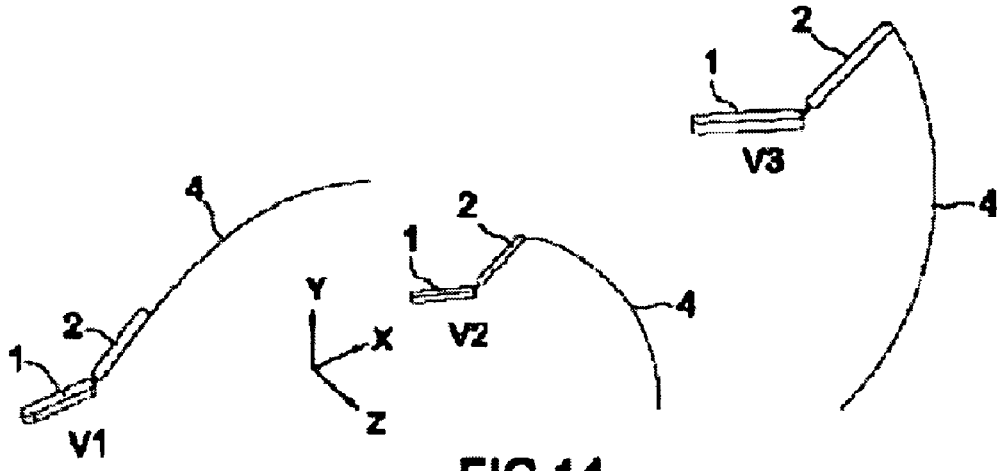
FIG. 14 diagrammatically shows different orientations for the wire element of the antenna of FIG. 2.
Figure 15:
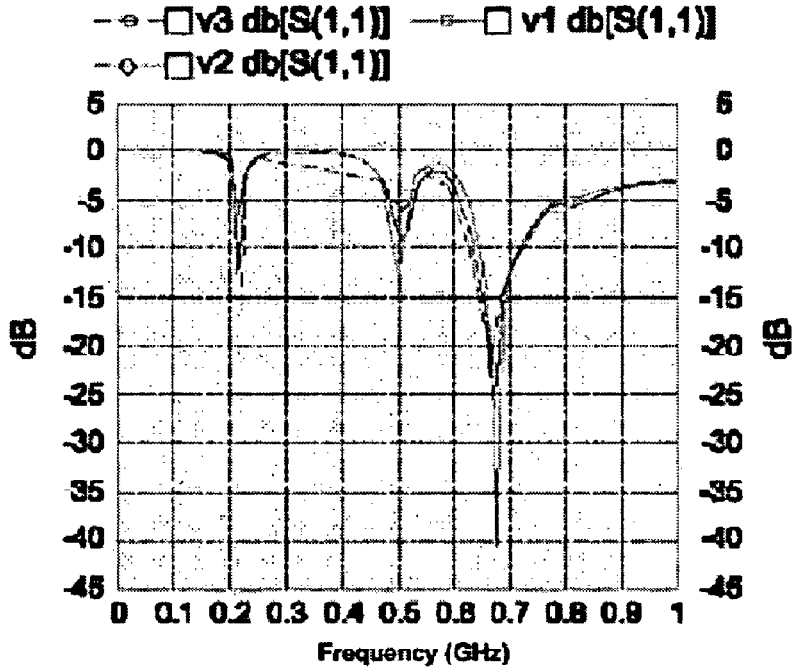
FIG. 15 shows the impedance matching curves of the different embodiments of FIG. 14.

With reference to FIGS. 14 and 15, the influence that the position of the conductive wire element 4 can have with respect to the hot arm 2 of the antenna will now be described. Indeed, the conductive wire element 4 is not necessarily taut in the extension of the hot arm 2. As shown in FIG. 15, which represents the S11 impedance matching for the three positions V1, V2, V3 shown in FIG. 4, it is seen that the antenna retains an entirely acceptable behaviour in the VHF and UHF band, irrespective of the position of the wire element 4. This modification in the shape of the wire element thus allows a certain flexibility to be obtained for the impedance matching of the antenna, for a given reception channel.

Figure 16:
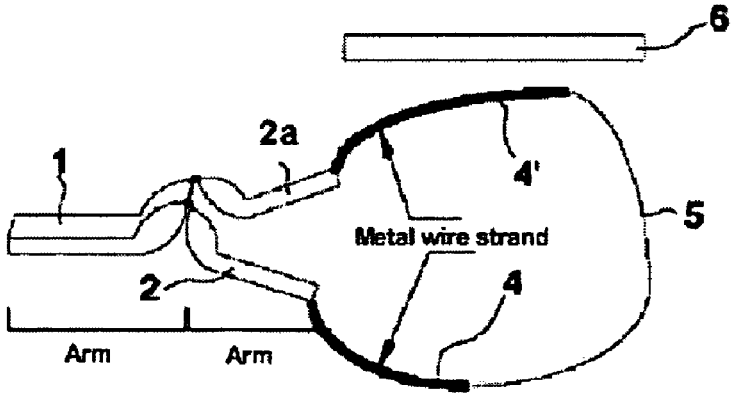
FIG. 16 is a diagrammatic view of an embodiment in accordance with the present invention, enabling the diversity to be obtained.

With reference to FIG. 16, a description will now be made of a particular embodiment of the antenna allowing an antenna system with diversity to be obtained that can operate in the UHF band and VHF band. In this case, the cold conductor arm 1 is connected to two hot arms, namely the arms 2 and 2*a*. As with the embodiment of FIG. 2, each hot arm is extended by a conductive wire strand (4, 4') which, in the embodiment shown, is mounted in a non-conductive sleeve 5 covering the two strands 4 and 4'. This particular embodiment enables a loop to be formed to suspend the antenna. The dimensions of the different elements of this antenna system are calculated as described for the antenna of FIG. 2.

Figure 17:
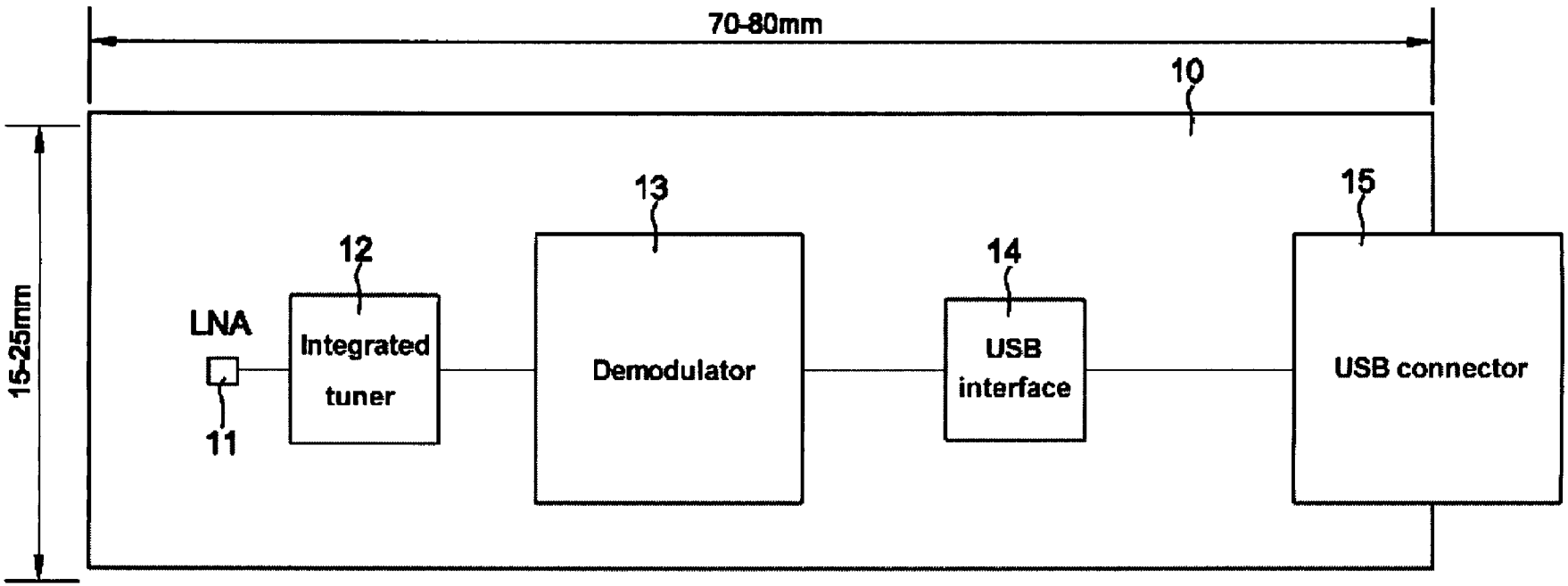
FIG. 17 is a diagrammatic representation of an electronic card used with the antennas in accordance with the present invention.

Moreover, with reference to FIG. 17, an example of an electronic card will be described that can be used with an antenna in accordance with the present invention, as described in FIG. 2. This electronic card is designed to be inserted in the box containing the cold arm 1 as cover or as a box element. This electronic card 10 comprises an LNA amplifier 11 to which is connected the coaxial cable of the antenna at the level of the articulation 3. The LNA 11 is connected to an incorporated tuner 12 processing both the VHF band and the UHF band. The tuner 12 is connected to a demodulator 13 the output of which is connected to a USB interface 14, itself connected to a USB connector 15. It is therefore possible with this system to connect the antenna to the USB input of a laptop computer or any other display element, which particularly enables terrestrial digital television to be received on the computer, PDA or other portable device.

What is claimed is:

1. A portable broadband compact antenna device comprising a first radiating element of the dipole type, operating in a first frequency band and formed by a first conductive arm and a second conductive arm, said first and second conductive arms being supplied differentially, the first arm, called cold arm, forming at least one cover for an electronic card and a second radiating element operating in a second frequency band constituted by the first arm and the second arm, extended by a conductive wire element the length of the assembly formed by the first arm, the second arm and the wire element determining the value of said second frequency band and being equal to $\lambda 2/(2\times(1+\alpha))$ where $\lambda 2$ is the wavelength at the central frequency of the second frequency band and $\alpha$ is a coefficient between 0 and 1.

2. The antenna of claim 1, wherein $\alpha$ is between 0.15 and 0.2.

3. The antenna of claim 1, wherein the first frequency band is the UHF band and the second frequency band is the VHF band.

4. The antenna of claim 3, wherein the VHF frequency band is the VHF-III band.

5. The antenna of claim 1, wherein the wire element is inserted next to a slot provided in the second arm.

6. The antenna of claim 1, wherein the wire element is formed by retractable elements in a sleeve integral with the second arm.

7. The antenna of claim 1, wherein the first and second conductive arms of the first radiating element, each have a length equal to $\lambda 1/4$ where $\lambda 1$ is the wavelength at the central frequency of the first frequency band.

8. A portable compact broadband antenna device comprising a first radiating element of the dipole type operating in a first frequency band and formed by a first conductive arm and two second conductive arms, said both second conductive arms being mounted in rotation at a same extremity of the first conductive arm and being supplied differentially, the first conductive arm, called cold arm, forming at least one cover for an electronic card, and second radiating elements operating in a second frequency band and constituted by the first arm and one of the second arms, extended by a conductive wire element, the length of each assembly formed by the first arm, one of the second arms and one of the conductive wires determining the value of said second frequency band and being equal to $\lambda 2/(2\times(1+\alpha))$ where $\lambda 2$ is the wavelength at the central frequency of the second frequency band and $\alpha$ is a coefficient between 0 and 1.

9. The antenna of claim 8 wherein $\propto$ is between 0.15 and 0.2.

10. The antenna of claim 8, wherein the first and second conductive arms of the first radiating element, each have a length equal to $\lambda 1/4$ where $\lambda 1$ is the wavelength at the central frequency of the first frequency band.

* * * * *